US010941968B2

(12) United States Patent
Vaishnav

(10) Patent No.: US 10,941,968 B2
(45) Date of Patent: Mar. 9, 2021

(54) REFRIGERATED DRYER POWER SAVING CONTROLS

(71) Applicant: INGERSOLL-RAND INDUSTRIAL U.S., INC., Davidson, NC (US)

(72) Inventor: Lalitkumar Jamnadas Vaishnav, Gujarat (IN)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 297 days.

(21) Appl. No.: 15/243,430

(22) Filed: Aug. 22, 2016

(65) Prior Publication Data

US 2017/0059220 A1 Mar. 2, 2017

Related U.S. Application Data

(60) Provisional application No. 62/209,112, filed on Aug. 24, 2015.

(51) Int. Cl.
*F25B 49/02* (2006.01)
*F25B 1/00* (2006.01)

(52) U.S. Cl.
CPC ..... *F25B 49/022* (2013.01); *F25B 1/00* (2013.01); *F25B 49/02* (2013.01); *F25B 2600/0261* (2013.01); *F25B 2700/21151* (2013.01); *F25B 2700/21152* (2013.01); *F25B 2700/21174* (2013.01)

(58) Field of Classification Search
CPC ..... F25B 49/022; F25B 49/02; F25B 1/00
See application file for complete search history.

(56) References Cited

U.S. PATENT DOCUMENTS

| | | | | |
|---|---|---|---|---|
| 4,101,100 | A * | 7/1978 | Smith | A62C 33/06 104/275 |
| 4,397,664 | A * | 8/1983 | Kramers | B64D 13/08 361/696 |
| 6,817,198 | B2 | 11/2004 | Wilson et al. | |
| 7,134,483 | B2 | 11/2006 | Barnwell | |
| 7,475,556 | B2 | 1/2009 | Amo | |
| 8,443,868 | B2 | 5/2013 | Barnwell | |
| 9,016,087 | B2 * | 4/2015 | Urbain | B64F 1/364 62/239 |
| 2002/0174665 | A1 * | 11/2002 | Pritchard | B01D 53/265 62/93 |
| 2006/0201167 | A1 | 9/2006 | Bellemo | |
| 2008/0173030 | A1 | 7/2008 | Levan et al. | |
| 2009/0112368 | A1 * | 4/2009 | Mann, III | B64F 1/34 700/275 |
| 2010/0107674 | A1 | 5/2010 | Aono | |
| 2014/0165633 | A1 * | 6/2014 | De Piero | B01D 53/265 62/93 |

* cited by examiner

*Primary Examiner* — Larry L Furdge
*Assistant Examiner* — Alexis K Cox
(74) *Attorney, Agent, or Firm* — Kevin E. West; Advent, LLP

(57) ABSTRACT

A control system for controlling a refrigerated dryer of a gas compressor system includes a controller and a flow sensor and can be selectively operated in a power saving mode in which the controller shuts down a refrigerant compressor included in the dryer system when the flow sensor indicates that no compressed gas is flowing through the dryer. The control system uses input from a temperature sensor to determine whether to activate the compressor regardless of the flow of compressed gas through the dryer.

6 Claims, 2 Drawing Sheets

REFRIGERATED DRYER POWER SAVING CONTROLS

TECHNICAL FIELD

The technical field generally relates to dryer systems, and more specifically, to refrigerated dryers for gas compressor systems.

BACKGROUND

Gas compressor systems are often used to provide compressed gas for use in industrial processes, such as compressed air for powering machinery, hand tools, and the like. Air compressors typically compress atmospheric air, which contains moisture. As a result, typical air compressors generate what is referred to as wet compressed air, wherein the term "wet" refers to the fact that there is typically undesirable amounts of liquid water, water vapor, and other contaminants in the compressed air. Because moisture can cause damage or corrosion in machines and tools, the compressed air supplied to a point of use should be substantially dry. Accordingly, dryers are generally provided upstream from a point of use in compressed air systems and serve to remove moisture and other contaminants from the compressed air or, more generally, the compressed gas. Typically refrigerated dryers use a refrigeration circuit to remove moisture from the compressed gas by cooling the gas to cause the moisture vapor in the gas to condense and separate from the compressed gas.

Refrigerated dryers may be either cyclic or non-cyclic. Conventional non-cyclic dryers generally operate a refrigerant compressor continuously, regardless of demand from the gas compressor, to provide a continuous flow of relatively cold refrigerant through a heat exchanger to cool the compressed gas and condense the entrained moisture. However, because the refrigerant compressor operates continuously, such non-cyclic dryers consume power even when there is no cooling demand from the gas compressor. Cyclic dryers include a cold sink, such as excess solid mass or a tank of fluid, to enable the refrigerant compressor to be run only periodically as needed to maintain the temperature of the cold sink within a prescribed range independent of demand. However, such cyclic dryers are relatively expensive due to the addition of the cold sink and the complexity involved in operating and controlling such a dryer. There remains a significant need for the unique apparatuses, systems, methods and controls disclosed herein.

SUMMARY

According to one aspect of the present disclosure, a control system and method of controlling a refrigerated dryer of a gas compressor system are disclosed. The control system selectively operates in a power saving mode in which the controller shuts down a refrigerant compressor included in the dryer system when a flow sensor indicates that no compressed gas is flowing through the dryer. The control system may use input from a temperature sensor to determine whether to activate the compressor regardless of the flow of compressed gas through the dryer. Further embodiments, forms, objects, features, advantages, aspects, and benefits shall become apparent from the following description and drawings.

DESCRIPTION OF ILLUSTRATIVE EMBODIMENTS

Figure 1:
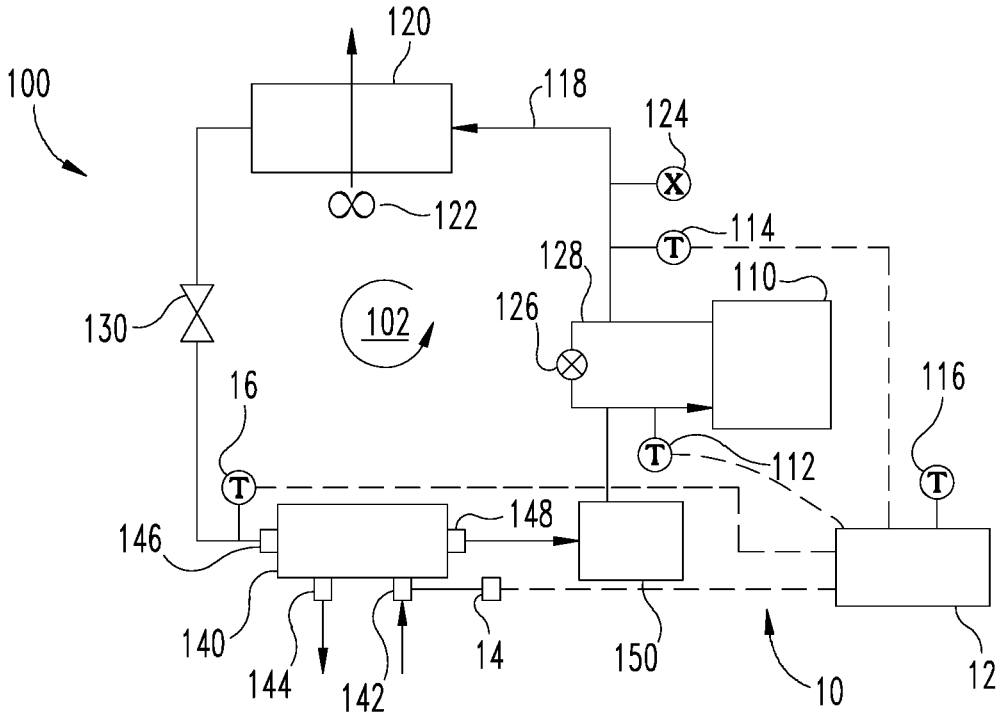
FIG. 1 is a schematic of a refrigerated dryer system according to an embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

According to one aspect of the present disclosure, a control system and method of controlling a refrigerated dryer of a gas compressor system are disclosed. The control system, including a controller and a flow sensor, selectively operates in a power saving mode in which the controller shuts down a refrigerant compressor included in the dryer system when the flow sensor indicates that no compressed gas is flowing through the dryer. In a further aspect of the present disclosure, the control system uses input from a temperature sensor to determine whether to activate the compressor regardless of the flow of compressed gas through the dryer. Consequently, the control system enables the dryer to perform with aspects of both non-cyclic and cyclic dryers without the added cost and complexity of a conventional cyclic dryer. Moreover, the power saving mode of the controller may increase the reliability of the dryer system by lowering the duty cycle and wear and tear on its components.

With reference to FIG. 1 there is illustrated an embodiment of a control system 10 for a refrigerated dryer. Control system 10 includes a flow sensor 14 and an evaporator temperature sensor 16, each in communication with a controller 12 which may be structured as a microprocessor based electronic controller. The control system 10 may be incorporated into a dryer system 100 including a compressor 110 fluidly connected to a condenser 120 by a refrigerant line 118 through which a refrigerant may flow. The compressor 110 and condenser 120 may be further fluidly connected to a valve 130 such as a throttle valve or controllable valve and an evaporator 140 by the refrigerant line 118. The refrigerant line 118 may further fluidly connect the evaporator 140 to the compressor 110 to complete a refrigeration circuit 102 comprising the dryer system 100. In certain embodiments, the dryer system 100 may include an accumulator 150 disposed between the evaporator 140 and the compressor 110 and fluidly connected to each by the refrigerant line 118, the accumulator 150 structured to collect liquid refrigerant from the refrigerant line 118 before entering the compressor 110. To improve heat transfer from the condenser 120, ambient air flow may be generated over the condenser 120 using a cooling fan 122. The dryer system 100 may further include a pressure relief valve 124 in communication with the refrigerant line 118 and disposed between the compressor 110 and the condenser 120.

Figure 2:
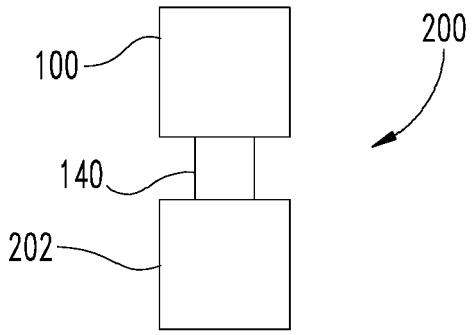
FIG. 2 is a schematic of a gas compressor system according to an embodiment of the present disclosure.

As shown in FIG. 2, the dryer system 100 may be a portion of a gas compressor system 200 structured to compress a gas using a gas compressor circuit 202, having a gas compressor (not shown), and to deliver the compressed gas to a point of use. However, the refrigeration circuit 102 may be operated independently of the gas compressor and the gas compressor circuit 202. The dryer system 100 is structured to lower the temperature of the compressed gas routed through the evaporator 140 to enable moisture and contaminant gases to be condensed from the compressed gas and subsequently removed. Accordingly, the evaporator 140 provides an interface between the refrigeration circuit 102 of the dryer system 100 and the gas compressor circuit 202 of the gas compressor system 200 through which heat is transferred from the compressed gas in the gas compressor circuit 202 to the refrigerant flowing through the refrigeration circuit 102 and dissipated in the dryer system 100, specifically in the condenser 120. When the gas compressor is not operating, for instance, due to low demand for compressed gas, no compressed gas flows through the evaporator 140 and, therefore, little or no heat is transferred from the compressed gas to the dryer system 100.

In certain applications, the gas compressor circuit 202 may include a contact-cooled gas compressor, which uses a cooling fluid, such as water, injected into the gas compressor to dissipate heat generated by the compression process via evaporative cooling. Thus, the dryer system 100 enables the cooling fluid and other contaminants to be removed from the compressed gas downstream of the gas compressor. The gas to be compressed may be atmospheric air, natural gas, nitrogen, or any other desired gas to be compressed for downstream use, particularly any gas that may contain water vapor (i.e., moisture) entrained in the gas to be compressed or any other contaminant gas that may be condensed by the dryer system 100. The gas compressor circuit 202 may include a separator downstream of the evaporator 140 structured to separate the condensate formed in the evaporator from the compressed gas prior to be routed to the point of use.

Referring again to FIG. 1, the evaporator 140 may include a compressed gas inlet 142, a compressed gas outlet 144, a refrigerant inlet 146, and a refrigerant outlet 148. The evaporator 140 enables the transfer of thermal energy as heat from the relatively warm compressed gas, which is flowed through evaporator 140, entering via the gas inlet 142 and exiting via the gas outlet 144, when the gas compressor is operating. The transferred heat is transferred to the relatively cold refrigerant flowed through evaporator 140 when the compressor 110 is operating, entering via the refrigerant inlet 146 and exiting via the refrigerant outlet 148. The thermal energy transferred from the compressed gas to the refrigerant in the evaporator 140 increases the temperature of the refrigerant and the evaporator 140. The evaporator 140 may be any suitable type of heat exchanger that enables thermal contact between the compressed gas and the refrigerant but maintains physical separation, including without limitation a shell and tube exchanger, a plate exchanger, a plate and shell exchanger, and a plate-fin exchanger. The evaporator 140 may be referred to as a chiller in certain applications.

The controller 12 of the control system 10 may be structured to accept input from the evaporator temperature sensor 16 and the flow sensor 14 to determine when to activate and deactivate the compressor 110 of the dryer system 100. The flow sensor 14 is located in communication with the flow of compressed gas into and/or out of the evaporator 140 to determine whether compressed gas is flowing therethrough. Accordingly, the flow sensor 14 may be disposed adjacent the gas inlet 142 or the gas outlet 144 in alternative embodiments of the present disclosure. The flow sensor 14 may be any suitable type of flow sensing device, including without limitation a differential pressure flowmeter, such as a venturi tube, pilot tube, or a rotameter; a mechanical flowmeter, such as a rotary vane, gear, or turbine; and a thermal mass flowmeter. In at least one embodiment, the flow sensor 14 may be a flow switch providing a binary on/off indication of the presence of a flow through the evaporator 140.

The evaporator temperature sensor 16 may be disposed adjacent the evaporator 140. In certain embodiments, the evaporator temperature sensor 16 may be disposed adjacent the refrigerant inlet 146 of the evaporator 140. In such an embodiment, the evaporator temperature sensor 16 may provide input to the controller 12 indicating the temperature of the refrigerant entering the evaporator 140 at the refrigerant inlet 146. Because of the heat transfer across the evaporator 140, the evaporator 140 does not have a single temperature. Consequently, the controller 12 may use the temperature indicated by the evaporator temperature sensor 16 as a proxy for the temperature of the evaporator 140. In addition on or more temperature sensors may be used within and/or downstream of the evaporator 140.

The dryer system 100 may include a compressor inlet temperature sensor 112 disposed adjacent an inlet of the compressor 110, a compressor outlet temperature sensor 114 disposed adjacent an outlet of the compressor 110, and an ambient temperature sensor 116 that may be disposed adjacent the condenser 120, each in communication with and monitored by the controller 12. The evaporator temperature sensor 16, the compressor inlet temperature sensor 112, the compressor outlet temperature sensor 114, and ambient temperature sensor 116 may be any suitable type or types of temperature sensor, including without limitation a thermocouple, a resistive temperature device (RTD), a thermistor, an infrared radiator, a bimetallic device, a liquid expansion device, a molecular change-of-state device, a thermostatic switch, and a silicon diode. The dryer system 100 may further include a relative humidity sensor (not shown) in communication with the controller 12 structured to indicate the relative amount of moisture in the compressed gas.

The dryer system 100 may further include a bypass valve 126 fluidly connected with the refrigerant line 118 via a bypass line 128. As shown FIG. 1, the bypass line 128 and bypass valve 126 may be configured to route relatively warm, high pressure refrigerant from the refrigerant line 118 downstream of the compressor 110 into the refrigerant line 118 downstream of the evaporator 140, thereby selectively bypassing the condenser 120, valve 130, and evaporator 140. Particularly during low load and/or low temperature operation, if the pressure in the refrigerant line 118 downstream of the evaporator 140 falls below a predetermined value, the bypass valve 126 may modulate open to route at least a portion of the relatively warm refrigerant directly into the refrigerant line 118 downstream of the evaporator 140, thus raising the pressure and temperature at the evaporator 140. Thus, the bypass valve 126 may automatically maintain a desired temperature at the evaporator 140 across a wide range of operating and ambient conditions. Consequently, in certain operating modes, the bypass valve 126 may prevent freezing of the evaporator 140 and a low pressure condition at an inlet of the compressor 110. In at least one embodiment, the bypass valve 126 is a mechanical pressure-sensitive valve that opens when the pressure in the refrigerant line 118 downstream of the evaporator 140 falls below the predetermined value relative to the pressure in the refrigerant line 118 downstream of the compressor 100. Though useful under certain operating conditions, the bypass valve 126 generally increases both the initial cost and life cycle cost of the dryer system 100 through increased part count and reduced efficiency as bypassed refrigerant does no useful cooling and as the compressor 110 generally operates at a higher pressure than necessary.

The controller 12 may include various operating modes. In at least one embodiment, the controller 12 may include a normal mode of operation suitable for various load conditions on the dryer system 100 due to operation of the gas compressor circuit 202. In normal mode, the dryer system 100 may operate as a non-cyclic dryer, meaning the compressor 110 generally runs continuously regulated by the bypass valve 126. During operation in normal mode, the controller 12 may activate the compressor 110, which may run continuously irrespective of the load conditions imposed by the gas compressor circuit 202. The controller 12 may include an interlock safety in which the controller 12 may deactivate (i.e., shut down) the compressor 110 if the evaporator temperature sensor 16 indicates a temperature less than a prescribed lower limit while operating in normal mode. Shutting down the compressor 110 when the temperature of the evaporator 140 reaches a lower limit may prevent freezing and thus damage to the evaporator. In certain embodiments, the prescribed lower limit may be −1° C. Once the interlock safety has been triggered, the controller 12 may reactivate the compressor 110 when the evaporator temperature sensor 16 indicates a temperature greater than a reset temperature. In certain embodiments, the reset temperature may be 3° C. The interlock safety may be triggered during load conditions where there is insufficient flow of compressed gas through the gas compressor circuit 202 to transfer adequate heat to the evaporator 140 to maintain a desired temperature in the evaporator 140.

Controller 12 further includes a power-save mode of operation suitable for certain load conditions on the dryer system 100. The controller 12 may switch from the normal mode to power-save mode of operation when there is no load on the dryer system 100 from the gas compressor circuit 202. To determine whether there is a load on the dryer system 100 from the gas compressor circuit 202, the controller 12 may monitor the flow sensor 14 and switch to power-save mode when the flow sensor 14 indicates little or no flow of compressed gas. Operating in power-save mode, the controller 12 may deactivate the compressor 110 when the flow sensor 14 indicates that no compressed gas is flowing through the evaporator 140 while the controller 12 continues to monitor the flow sensor 14. When the flow sensor 14 indicates that the flow of compressed gas through the evaporator 140 has resumed, the controller 12 may switch to normal mode and reactivate the compressor 110 to circulate refrigerant through the evaporator 140.

In power-save mode, the controller 12 may further monitor the evaporator temperature sensor 16. In certain embodiments, upon entering power-save mode (i.e., when the flow sensor 14 indicates that no compressed gas is flowing through the evaporator 140), the controller 12 may not deactivate the compressor 110 until or unless the evaporator temperature sensor 16 indicates that the temperature at or near the evaporator 140 is at or below a power-save lower limit. Once the temperature of the evaporator 140 is at or below the power-save lower limit, then the controller 12 may deactivate the compressor 110. Such a delay in deactivation of the compressor 110 ensures the dryer system 100 will be able to provide adequate cooling of the compressed gas once flow through the evaporator 140 resumes.

While the compressor 110 is shut down in power-save mode, the temperature of the evaporator 140 will increase over time, the rate of increase being dependent on such factors as the ambient temperature around the dryer system 100, the mass of the evaporator 140, and the capacity of the dryer system 100 among others. In power-save mode, the controller 12 may be further responsive to the compressor 110 if or when the evaporator temperature sensor 16 indicates that the temperature at or near the evaporator 140 is at or above a power-save upper limit regardless of the load condition indicated by the flow sensor 14. Reactivating the compressor 110 when the evaporator 140 reaches the power-save upper limit may ensure that the dryer system 100 can provide adequate cooling of the compressed gas once flow through the evaporator 140 resumes. The controller 12 may then continue to operate the compressor 110 until the temperature of the evaporator 140 reaches the power-save lower limit, at which time the controller 12 may deactivate the compressor 110 if no flow is indicated through the evaporator 140 (i.e., a no-flow condition). Accordingly, the controller 12 may activate and deactivate the compressor 110 to ensure that the dryer system 100 can provide adequate cooling of the compressed gas once flow through the evaporator 140 resumes and the controller 12 switches to normal mode.

In certain embodiments, the power-save lower limit may be between about 1 and 3° C., and the power-save upper limit may be between about 17 and 20° C. In at least one embodiment, the power-save lower limit may be about 1° C., and the power-save upper limit may be about 18° C. In certain embodiments, the power-save lower limit and power-save upper limit may be programmable by a user of the dryer system 100. In certain embodiments, the time for the temperature of the evaporator 140 to increase from the power-save lower limit to the power-save upper limit when the compressor is deactivated may be around 45 to 50 minutes depending on a variety of factors. Further, in certain embodiments, reactivation of the compressor 110 may lower the temperature of the evaporator 140 from the power-save upper limit to the power-save lower limit in approximately 3 to 5 minutes. Consequently, during sustained periods of operation in power-save mode (i.e., no load from the gas compressor circuit 202), the controller 12 may operate the compressor 110 for only a few minutes of each hour that there is no load from the gas compressor circuit 202, resulting in significant power savings.

Figure 3:
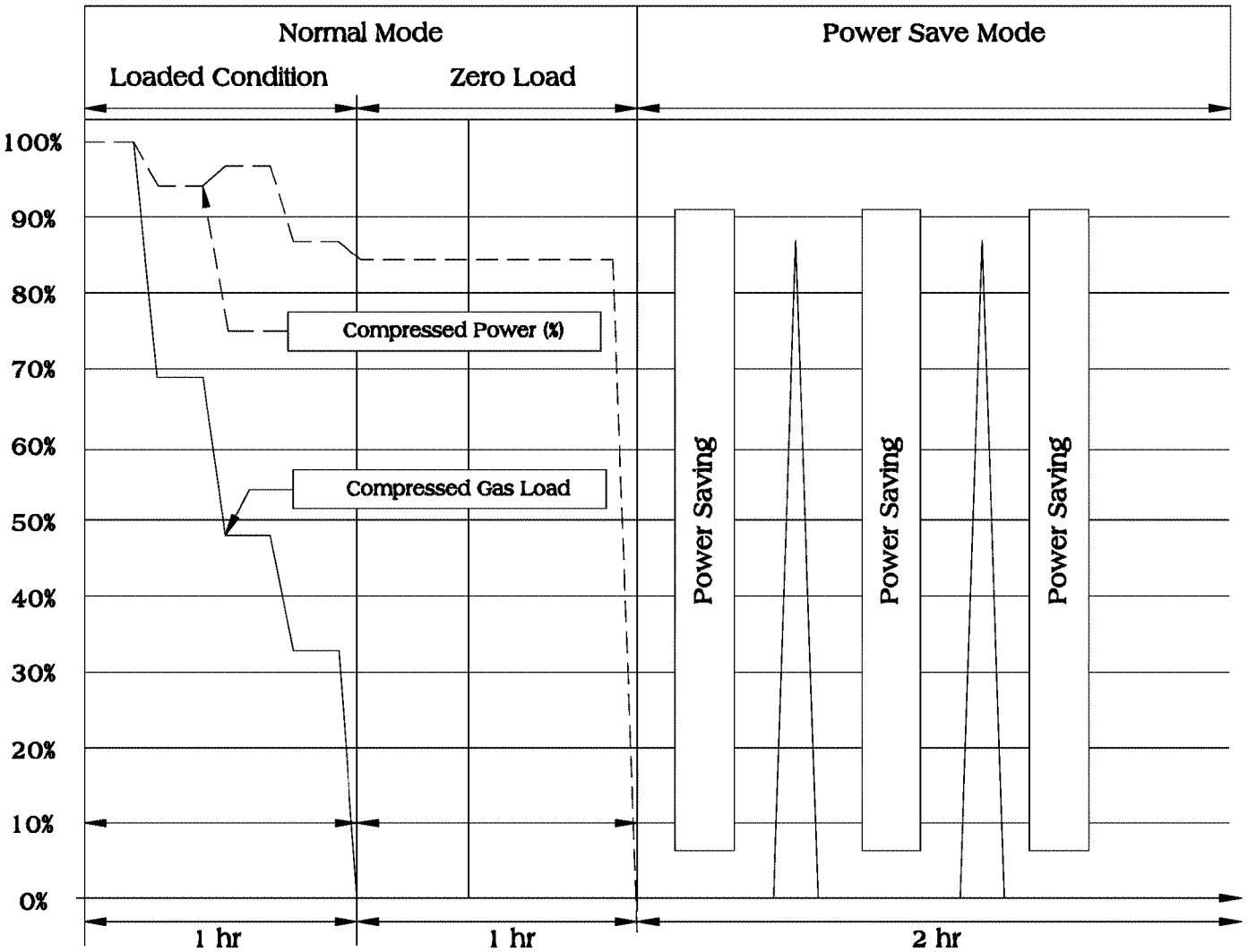
FIG. 3 is a chart illustrating various operating modes of a dryer system according to an embodiment of the present disclosure.

FIG. 3 illustrates the potential relative power savings of the different operating modes of the non-cyclic dryer system 100. From left to right, FIG. 3 depicts the normal mode under both a loaded condition, in which compressed gas flows through the evaporator 140, and a zero load condition, in which no compressed gas flows through the evaporator 140. FIG. 3 further depicts the power-save mode under zero load. Specifically, FIG. 3 depicts a flow of compressed gas (in percentage terms) through the evaporator 140, which is proportional to the load on the dryer system 100. Accordingly, the first hour of operation is labelled "Loaded Condition." Proceeding in time, the flow of compressed gas through the evaporator 140 falls to zero. Accordingly, the remaining period of operation is labelled "Zero Load." During normal mode operation, the power consumed by the compressor 110 of the dryer system 100 may fluctuate under both loaded and zero load conditions in response to changing system conditions, including variations in the flow of compressed gas. However, for clarity, the load of compressed gas flow and the power consumed by the compressor 110 is shown as either on (i.e., 100%) or off (i.e., 0%). Thus, FIG. 3 further illustrates that, in normal mode, the compressor 110 continues to consume power even under the zero load condition.

As shown in FIG. 3, upon switching to power-save mode, the controller 12 deactivates the compressor 110, and the power consumed by the compressor 110 drops to zero. Further, the controller 12 periodically reactivates and deactivates the compressor 110 as described herein, causing power spikes and thereby maintaining the temperature of the evaporator 140 between the power-save upper and power-save lower limits. The periods during which the compressor 110 is not operating due to a lack of load on the dryer system 100 represent potential power savings. Consequently, the dryer system 100 operating in power-save mode may yield power savings of nearly 95% compared with operation in normal mode under zero load conditions. Moreover, operating in power-save mode will increase the reliability of the dryer system 100 by lowering the duty cycle and wear and tear on the components of the dryer system 100. Further, the power-save mode offers a unique competitive feature, enabling the dryer system 100 to perform with some of the advantages a cyclic dryer without the added cost and complexity of a conventional cyclic dryer.

The controller 12 may comprise digital circuitry, analog circuitry, or a hybrid combination of both of these types. Also, the controller 12 can be programmable, an integrated state machine, or a hybrid combination thereof. The controller 12 can include one or more Arithmetic Logic Units (ALUs), Central Processing Units (CPUs), memories, limiters, conditioners, filters, format converters, or the like which are not shown to preserve clarity. In one form, the controller 12 is of a programmable variety that executes algorithms and processes data in accordance with operating logic that is defined by programming instructions (such as software or firmware). Alternatively or additionally, operating logic for the controller 12 can be at least partially defined by hardwired logic or other hardware. It should be appreciated that the controller 12 can be exclusively dedicated to regulate the activation and deactivation of the compressor 110 or may further be used in the regulation, control, or activation of one or more other subsystems or aspects of the dryer system 100.

The controller 12 may include one or more modules structured to functionally execute the operations of the controller 12. In certain embodiments, the modules of the controller 12 may correspond to the operating modes described herein. Accordingly, the controller 12 may include a module for operating in normal mode and a separate module for operating in power-save mode. Alternatively, the controller 12 may include a module that executes both normal and power-save modes. The description herein including modules emphasizes the structural independence of the aspects of the controller 12, and illustrates one grouping of operations and responsibilities of the controller 12. Other groupings that execute similar overall operations are understood within the scope of the present disclosure. Modules may be implemented in hardware and/or software on a non-transient computer readable storage medium, and modules may be distributed across various hardware or software components.

As will be understood by one skilled in the art having the benefit of the present disclosure, the terms used to identify the components of the dryer systems disclosed herein may be similarly described by other terms unless explicitly provided to the contrary. For example, the dryer system 100 may be referred to as an integrated air dryer system, an air compressor unit, or simply a dryer. Such difference in terms does not restrict the structure or operation of the disclosed dryer systems.

While various embodiments of a dryer and control system and methods for using the same have been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected. A variety of further embodiments according to the present disclosure are contemplated. Those skilled in the art will appreciate that many modifications are possible in the example embodiments without materially departing from this disclosure. Accordingly, all such modifications are intended to be included within the scope of this disclosure as defined in the following claims.

What is claimed is:

1. A refrigerated gas dryer for a gas compressor system comprising: a refrigerant circuit including a compressor, a condenser, and an evaporator; a flow sensor structured to sense gas flow in a compressed gas circuit of the gas compressor system, the compressed gas circuit in thermal communication with the evaporator; a temperature sensor structured to provide temperature information of the evaporator; and a controller in communication with the flow sensor, the temperature sensor and the compressor, wherein the controller is configured to activate and deactivate the compressor based on sensed outputs from the flow sensor and the temperature sensor so that the compressor is deactivated in response to both a sensed flow of compressed gas through the compressed gas circuit meeting a first condition and a sensed temperature of the evaporator meeting a second condition;

wherein the evaporator defines a compressed gas passage, and wherein the first condition is characterized by no flow of the compressed gas through the compressed gas passage defined by the evaporator and the second condition is characterized by a temperature of the evaporator at or below a lower limit.

2. The refrigerated gas dryer of claim 1, wherein the controller is configured to activate the compressor at a third condition characterized by the flow sensor indicating the presence of compressed gas in the compressed gas passage defined by the evaporator or activate the compressor at a fourth condition characterized by the temperature sensor indicating that the temperature of the evaporator is at or above an upper limit.

3. The refrigerated gas dryer of claim 1, wherein the flow sensor is in operable communication with at least one of an inlet or an outlet of the compressed gas passage defined by the evaporator.

4. The refrigerated gas dryer of claim 1, wherein the dryer is operably connected to a gas compressor and the gas is compressed by the gas compressor.

5. The refrigerated gas dryer of claim 4, wherein the dryer includes a bypass valve configured to place an output line of the compressor in fluid communication with an output line of the evaporator.

6. The refrigerated gas dryer of claim 1, wherein the controller is operable in first and second modes, wherein the first mode of operation is non-cyclic and the second mode deactivates the compressor under predetermined conditions.

* * * * *